US005682733A

United States Patent [19]

Perrone

[11] Patent Number: 5,682,733

[45] Date of Patent: Nov. 4, 1997

[54] APPARATUS FOR ENROBING TABLETS

[76] Inventor: Aldo Perrone, 7 Blue Jay Crescent, Brampton, Ontario, Canada, L6T 3Z8

[21] Appl. No.: 647,038

[22] Filed: May 9, 1996

[51] Int. Cl.[6] ..... B65B 9/04; B65B 47/02; B65B 47/10

[52] U.S. Cl. ..... 53/560; 53/553; 53/900

[58] Field of Search ..... 53/560, 559, 553, 53/900, 454, 453, 546

[56] References Cited

U.S. PATENT DOCUMENTS

| | | | |
|---|---|---|---|
| 2,219,578 | 10/1940 | Pittenger | 18/21 |
| 2,296,294 | 9/1942 | Scherer | 18/21 |
| 2,323,581 | 7/1943 | Weckesser | 18/21 |
| 2,367,802 | 1/1945 | Scherer | 18/21 |
| 2,387,747 | 10/1945 | Cowley | 18/21 |
| 2,497,212 | 2/1950 | Donofrio | 53/141 X |
| 2,513,852 | 7/1950 | Donofrio | 18/21 |
| 2,608,405 | 8/1952 | Salfisberg et al. | 271/2.3 |
| 2,624,164 | 1/1953 | Donofrio | 53/560 X |
| 2,663,128 | 12/1953 | Stirn et al. | 53/5 |
| 2,697,317 | 12/1954 | Stirn et al. | 53/89.5 |
| 2,902,802 | 9/1959 | Stirn et al. | 53/560 X |
| 3,269,088 | 8/1966 | Kath | 53/560 |
| 3,871,155 | 3/1975 | Blaser | 53/559 X |
| 4,034,536 | 7/1977 | Mahaffy et al. | 53/22 |
| 4,567,714 | 2/1986 | Chasman | 53/438 |
| 5,074,102 | 12/1991 | Simpson et al. | 53/454 |
| 5,459,983 | 10/1995 | Sadek et al. | 53/560 |

FOREIGN PATENT DOCUMENTS 535783 1/1957 Canada .

*Primary Examiner*—James F. Coan
*Attorney, Agent, or Firm*—Bliss McGlynn, P.C.

[57] ABSTRACT

An apparatus for enrobing medicine tablets in gelatin and employing a main linked track of die blocks with each block having a number of recesses formed in its top surface. A revolving co-operating die device in the form of another linked track or a cylindrical rotary die is adjacent to and in contact with the main linked track. This device also has a plurality of recesses, each of which is cooperable with a recess of similar size in the main link track to provide an enclosed cavity at at least one point along an upper path traversed by the main link track. This cavity is capable of holding one of the tablets. A first elastic gelatin strip is delivered to the main linked track and positioned for movement along its upper path. A vacuum system causes portions of the first gelatin strip to be pulled and stretched against walls of recesses in the die blocks to form tablet receiving depressions. A tablet dispenser drops tablets into these depressions. The tablets then move with the first gelatin strip to a region of contact between the main linked track and the die device. A second gelatin strip is delivered to the apparatus so that it is laid over the first gelatin strip when the two strips reach the region of contact. Portions of the second strip are stretched in the recesses of the die device in order to enrobe the tablets.

35 Claims, 7 Drawing Sheets

APPARATUS FOR ENROBING TABLETS

BACKGROUND OF THE INVENTION

This invention relates to apparatus for enrobing medicine tablets in a digestible film.

It has long been known in the pharmaceutical industry to provide drugs in the form of a capsule or tablet that can be readily swallowed by a person. The dosage form known as a tablet is solid and hard with a predetermined shape. The active ingredients in the tablet are held together with a suitable binder. In the usual capsule dosage form, the active ingredients generally occur in a flowable state such as in the form of a powder or a liquid. These active ingredients are encased in a digestible shell which commonly is made of gelatin or is gelatin based. The capsule dosage form can be made with a soft gelatin capsule or a hard gelatin capsule. The latter form of capsule normally comprises two pieces, each with a cylindrical form and a rounded end. These two pieces are filled with the flowable film material prior to assembly together. The two separate pieces may or may not be sealed together.

Recent U.S. Pat. No. 5,146,730 issued Sep. 15, 1992 to Banner Gelatin Products Corp. teaches a method and apparatus for producing medicine tablets that are enrobed in a gelatin coating formed by applying two layers of film to opposite sides of the tablet. Hard cores or preforms are dispensed on a self-timed basis into simultaneous contact with the two films which are supported on coacting rotary dies that come together to form a nip. The hard cores contact the films adjacent this nip at places which overlie recesses formed in the dies. The elastic films deform around each core and are sealed by the dies to each other. The dies then cut the covered cores from the films.

Although this known method and apparatus may work satisfactorily, because there is only a very narrow strip where the two rotating dies contact each other, this die system does not allow much time for the formation of the gelatin layers around the hard cores and the sealing of the two films together at the nip before the covered cores are completely severed from the films. This could give rise to manufacturing difficulties if the rotary dies are not manufactured very precisely and to very close tolerances and if the two rotary dies are not arranged very carefully and exactly relative to each other.

U.S. Pat. No. 4,567,714 issued Feb. 4, 1986 to S. A. Chasman describes a machine for forming capsules containing charges of powdered material. Two webs of gelatin material are directed along predetermined paths to a pair of cylindrical sealing rolls which form a nip between them. There is a compaction mechanism for forming predetermined charges of powdered material in the form of compacted slugs and a transfer roll transfers these slugs to cavities formed in the web of gelatin. Complete capsules containing the compacted slugs are formed at the nip of the cylindrical sealing rolls.

U.S. Pat. No. 5,074,102 issued Dec. 24, 1991 to W. M. Simpson et al. describes a machine for filling a powder, liquid or granule material into a soft shell capsule, which machine includes a flat linked track of cavity blocks. A strip of soft plastic or gelatinous material is fed onto the linked track. A vacuum system causes this strip of material to be pulled in tight against walls of the cavities during a filling step. A measuring roll is used to fill the partially formed capsules with a premeasured amount of active ingredient. A sealing roller is used then to seal the filled cavities by means of a plastic or gelatinous film. The aforementioned linked track is driven in an elliptical fashion past the feeding, vacuum and filling stations to an ejection device.

It is an object of the present invention to provide an apparatus for enrobing medicine tablets in a layer of gelatin, which apparatus will be reliable and not unduly complicated or difficult to manufacture and use.

It is a further object of the present invention to provide a machine or apparatus for enrobing solid medicine tablets in gelatin or another digestible protective material, which apparatus employs at least one linked track of die blocks with each block having at least one recess formed in a top or outer surface thereof.

SUMMARY OF THE INVENTION

According to one aspect of the invention, an apparatus for enrobing solid medicine tablets in a gelatin layer includes a main linked track of die blocks with each block having at least one recess formed in a top surface thereof and means for driving this linked track for movement along an upper path and return along a lower path. A revolving, cooperating die device is adjacent to and in contact with the main linked track and has a plurality of recesses, each of with is cooperable with a recess of similar size in the linked track to provide an enclosed cavity at at least one point along the upper path, this cavity being capable of holding one of the solid tablets. There is a drive system for revolving the die device so that the die device revolves in synchronism with the movement of the linked track. A feed system is also provided to deliver a first gelatin strip of selected thickness and composition to the main linked track. The first gelatin strip is positioned for generally linear movement along the upper path. A vacuum applying system causes portions of the first gelatin strip to be pulled and stretched against walls of the recesses in the die blocks, thereby forming tablet receiving depressions in the first gelatin strip at an upstream location along the upper path spaced from the location of contact between the die device and the linked track. A timed tablet dispensing mechanism is provided to dispense whole tablets into the depressions at a feeding location positioned between the upstream location and the location of contact. The tablets are dispensed so as to have a desired orientation in the depressions. A conditioning device conditions the first gelatin strip before the strip reaches the location of contact so that the first strip has a predetermined deformability and adhesivity to the tablets and to a second gelatin strip. There are also means for delivering a second gelatin strip of selected thickness and composition so that the second strip is laid over the first gelatin strip when the two strips reach the location of contact between the die device and the linked track. Each dispensed tablet moves with the first gelatin strip to the location of contact and a portion of the second gelatin strip is stretched in one of the recesses in the die device so that the tablet can be enrobed by portions of both the first and second gelatin strips.

Preferably, each die block in the main linked track has a number of recesses arranged in one or more rows extending transversely of the main linked track. In one embodiment, the die device comprises a second linked track of die blocks with each of these die blocks having at least one recess formed in an outwardly facing surface thereof and dimensioned in transverse and longitudinal directions thereof so as to correspond substantially to the size of the recesses in the main linked track.

According to another aspect of the invention, an apparatus for enrobing whole, solid, medicine tablets of predetermined size and shape with a gelatin layer includes a linked track of die blocks with each block comprising at least one recess formed in a top surface thereof and means for driving this linked track for movement along an upper path and return along a lower path. A cylindrical rotary die has a cylindrical surface that at one point about the circumference of the die is adjacent to and in contact with the linked track. The rotary die has a plurality of recesses each of which is cooperable with a recess of similar size in the linked track to provide at said one point an enclosed cavity capable of loosely holding one of the solid tablets. A drive mechanism rotates the rotary die so that the rotary die moves in synchronism with the movement of the linked track. A first feed system delivers a first elastic gelatin strip of selected thickness and composition to the upper path of the linked track for generally linear movement therealong. A second feed system delivers a second elastic gelatin strip of selected thickness and composition to the rotary die for movement along a circular path to said one point where the second gelatin strip meets the first gelatin strip. A vacuum applying system causes portions of the first gelatin strip to be pulled against walls of the recesses in the die blocks, thereby forming tablet receiving depressions in the first gelatin strip at an upstream location along the upper path spaced from said one point. A timed tablet dispensing mechanism dispenses individual whole, solid tablets into the depressions at a feeding location positioned between the upstream location and said one point. The tablets are dispensed so as to have a desired orientation in the depressions. Conditioning devices condition these gelatin strips before these strips reach said one point so that the strips have a predetermined deformability and adhesivity to the tablets and to each other. Each dispensed tablet moves with the first gelatin strip to and past said one point and a portion of the second gelation strip is deformed and stretched in one of said recesses in said rotary die around the tablet into enrobing engagement with the tablet.

Preferably each recess in the die blocks and in the rotary die has a raised rim extending about the perimeter of the recess. The die blocks of the linked track can be attached together by means of two linked chains located on opposite sides of the linked track.

Further features and advantages will become apparent from the following detailed description taken in conjunction with the accompanying drawings.

DETAILED DESCRIPTION OF PREFERRED EMBODIMENTS

Figure 1:
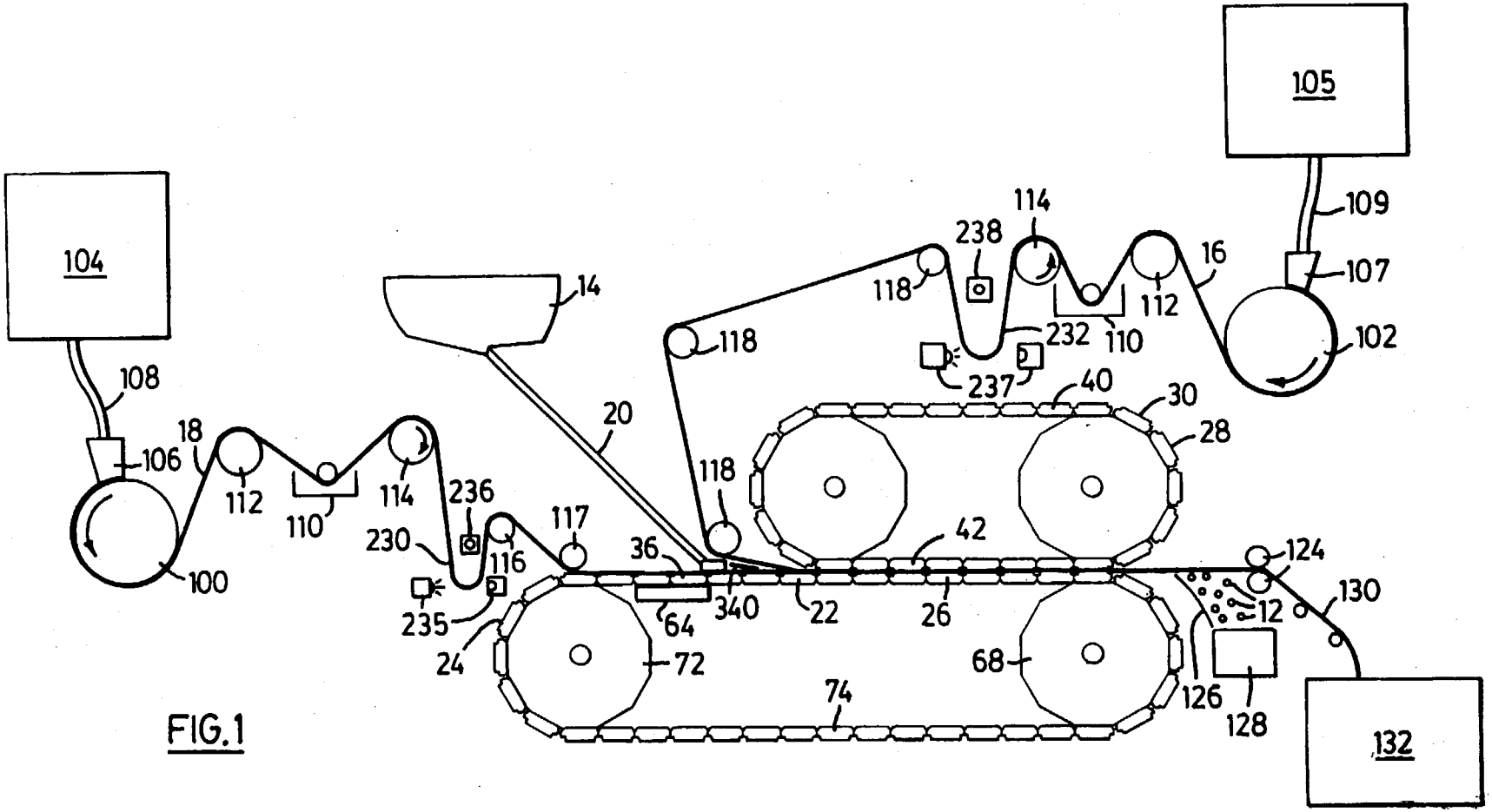
FIG. 1 is a simplified, partially schematic, elevational view of a preferred apparatus for enrobing solid medicine tablets in a gelatin layer or a layer of a similar digestible material.

FIG. 1 illustrates schematically a preferred apparatus 10 for completely enrobing medicine or similar tablets in a layer of gelatin, these finished tablets or capsules being indicated at 12. These capsules are completely enclosed and sealed and comprise preforms supplied from a bowl feeder 14 and two webs or films of gelatin indicated at 16 and 18. Individual preforms are dispensed into tablet receiving depressions formed in the first gelatin web or strip 18, the preforms being dispensed by a tablet dispensing mechanism indicated generally at 20. The two gelatin strips or films 16 and 18 are brought together at or near a meeting point or nip indicated at 22. In a first embodiment of the invention, the apparatus includes a main linked track 24 of die blocks 26 and a revolving, cooperating die device 28 that is adjacent to and in contact with the main linked track. In the first embodiment shown in FIG. 1 the die device 28 comprises a second linked track of die blocks 30. The blocks 30 can be similar to the blocks 26.

Figure 3:
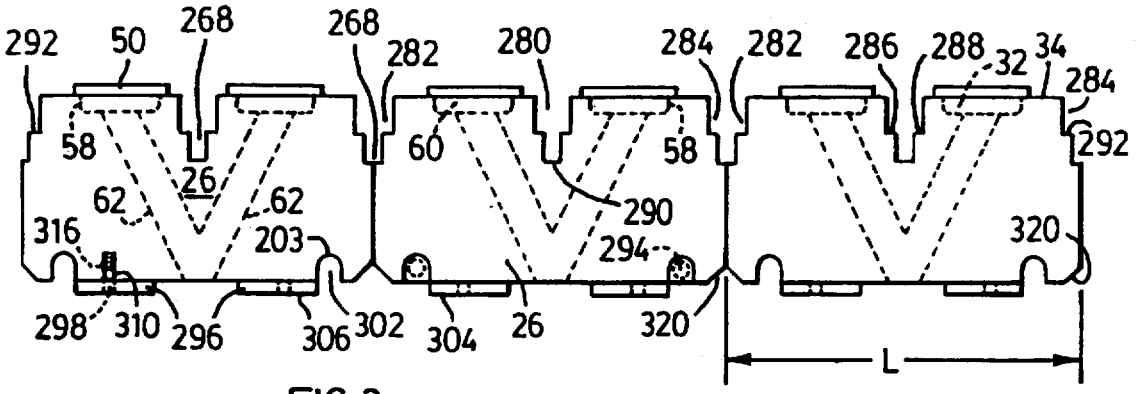
FIG. 3 is an enlarged side view of three adjacent die blocks used in the linked track.
Figure 4:
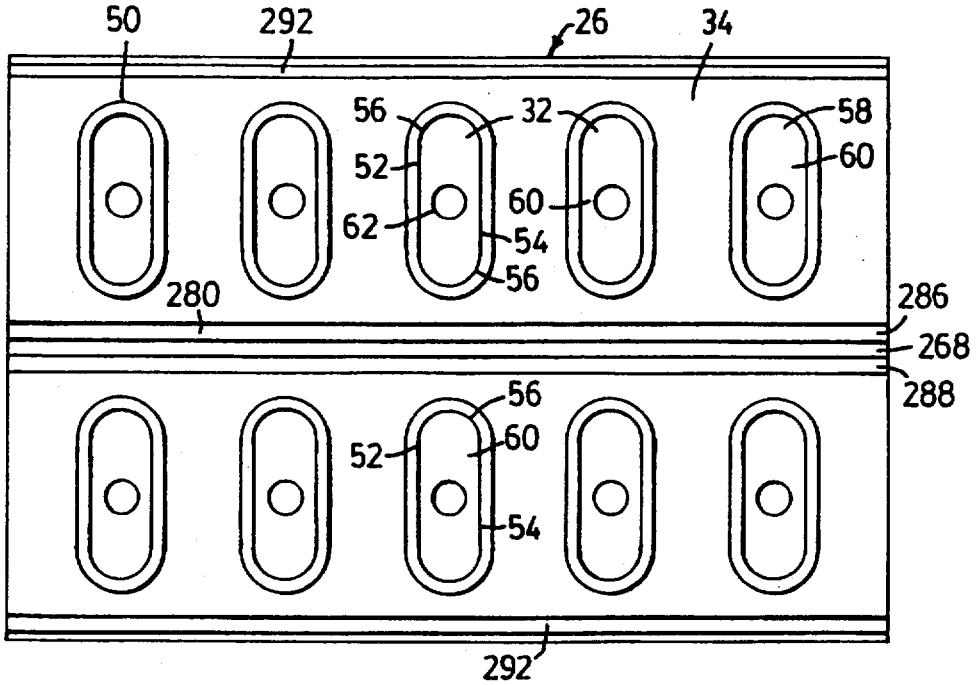
FIG. 4 is an enlarged top view of a single die block used in the linked track.
Figure 5:
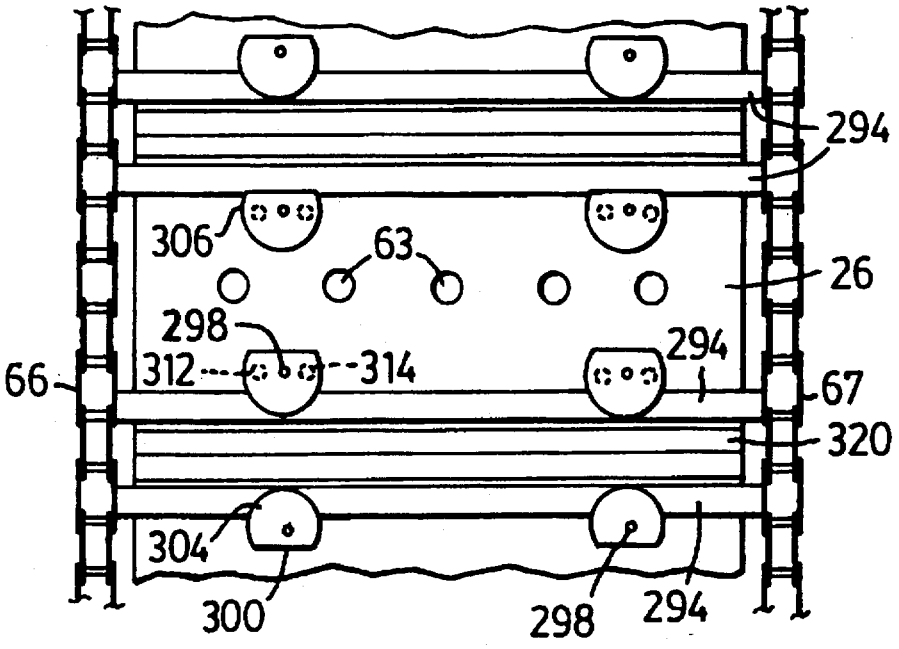
FIG. 5 is a bottom detail view of a portion of the linked track.

The construction of the die blocks 26 in the main linked track is illustrated in more detail in FIGS. 3 to 5. Each block 26 has at least one recess 32 formed in a top or outer surface 34 thereof. Preferably, a number of recesses 32 are formed in this top surface, these recesses being arranged in one or more rows extending transversely of the main linked track. In each die block 26 illustrated in FIGS. 3 and 4, there are two such transverse rows comprising five recesses 32.

Figure 2:
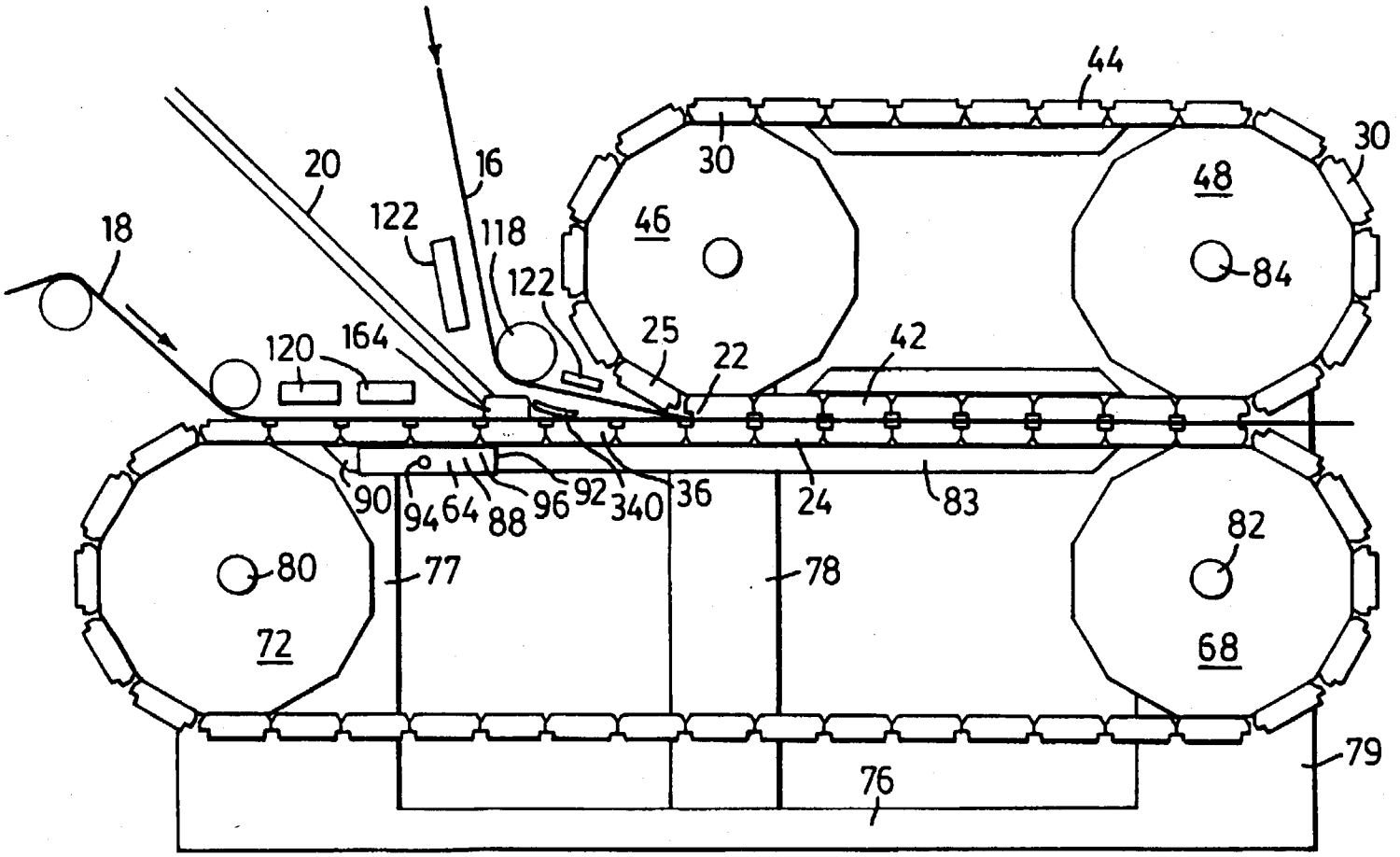
FIG. 2 is a side view of the main linked track, the cooperating die device and the tablet dispensing mechanism.

The die device 28 also has a plurality of recesses, each of which is cooperable with one of the recesses 32 in the main linked track. The recesses in the main linked track and in the die device 28 are of similar, preferably identical, size and shape and when two of these recesses from the main linked track and the die device come together along an upper path 36 of the main linked track, they form an enclosed cavity at at least one point along this upper path. This enclosed cavity is capable of holding one of the tablet preforms along with the gelatin layers that enclose same. In the embodiment of FIGS. 1 and 2, the second linked track forming the die device 28 is formed with at least one recess in an outwardly facing surface 40 thereof, this recess being dimensioned at least in the transverse and longitudinal directions thereof so as to correspond substantially to the size of the recesses 32 in the main linked track. The second linked track has a lower path 42 along which the second linked track follows closely the upper path 36 of the main linked track. The linked track 28 also has an upper path 44.

Each die block 26, in the illustrated version, is provided with a central channel 280 which separates two transverse rows of the recesses 32. Also, along the side edges of each block are transversely extending cut-outs 282 and 284. As shown in FIG. 3, oppositely facing cut-outs 282, 284 of adjacent blocks together form a channel having the same shape and size as the central channels 280. Also, each channel 280 has a narrower channel 268 formed in the bottom thereof. On opposite sides of each channel 268 are two shoulders 286, 288. The reason for the shoulder configuration in the channel 280 is to reduce the amount of material removed from the block in order to form a central channel having the depth of bottom 290. The removal of less material results in stronger block construction and more room in each block for passageways such as air passages 62 described further hereinafter. There is also a shoulder 292 formed in each of the cut-outs 282, 284. The shoulders 292 are of the same size and height as shoulders 286, 288.

In order to permit each block 26 to be attached to chain pins 294 (see FIG. 5), rotating lock plates 296 are attached to the bottom of each block. In the illustrated version, there are four such plates rotatably attached to each block by means of a pivot pin or screw 298. Each lock plate can be formed with a round circumference that is flattened on one side 300. The purpose of the flat side is to permit the plates to be rotated to a position whereby the die blocks 26 can be easily removed from the pins 294. The operator may wish to remove the die blocks either for purposes of maintenance or to replace them with a series of different die blocks having a different cavity shape or size. In order to accommodate the pins 294, bottom channels 302 with semi-cylindrical tops 303 are formed in each block. There are two such channels for each block located on opposite sides of the transverse centerline. By rotating the respective plates 296 so that their circular sections 304 extend over the open bottom of the channel, each block is connected firmly to its respective chain pins. To remove the block from its chain pins, its lock plates 296 are moved to the position shown at 306 in FIGS. 3 and 5. In this position, the flat side 300 of the plate is parallel to and close to the adjacent channel 302. In this position, the lock plate does not extend across the open bottom of the channel, leaving the channel open for removal of the chain pin.

In a preferred embodiment, a detent ball 310, only one of which is illustrated in FIG. 3, is mounted in each block 26 for each of the lock plates in order to hold the plate in the selected position. Suitable, shallow cavities indicated at 312 and 314 in FIG. 5 are formed in the upper surface of each lock plate. In a manner known per se, each ball 310 is biased downwardly by a small coil spring 316 mounted in a vertically extending cavity in the block above the ball. Thus, when the plate has been rotated to the desired position, the ball will be pushed downwardly by the spring into either cavity 312 or 314 to help hold the plate in the selected position. A suitable twisting force on the plate will overcome the spring force on the ball to permit the lock plate to be rotated.

Preferably each of the blocks 26 and 30 have their bottom, transverse edges angled or cut away as indicated at 320. This helps to prevent the bottom edges of the blocks from interfering with one another when the blocks are rotated about rolls 68, 72, 46 and 48 as described hereinafter.

There is also a drive system for driving the second linked track 28 for movement along its lower path and return along its upper path 44. This drive system can include the two rolls 46 and 48 of similar size along with two pairs of drive sprockets. The drive sprockets (not shown) are mounted at opposite ends of each roll 46, 48. These sprockets and the two drive chains that extend around them are similar to those illustrated schematically in FIG. 6 and used for the main linked track. Each of the linked tracks is driven so as to move in an intermittent stop-and-go manner by means of separate electrical stepper motors, each controlled by a PC computer to stop and start its track at the required intervals and drive its respective linked track at the required matching speed. These stepper motors are of standard known construction as is the control system for this type of motor and therefore a detailed discussion herein is deemed unnecessary.

Each recess 32 (and also each recess in the second linked track or die device 28) has a raised rim 50 which preferably has a width from one to two times the thickness of the gelatin web which is laid over the recess. For example, for a small size tablet or capsule, the width of the rim can be approximately 0.04 inch. The height of the rim 50 should be more than the thickness of the wet gelatin web. It will be appreciated that the surface of the rim 50 must be made to close tolerances as this rim must properly contact the rim of the opposing recess along the location of contact between the die device 28 and the main linked track. It will be understood that it is the two engaging rims that seal the web 16 and 18 about the preform and cut these webs in order to cut-out the complete capsule from the surrounding webs of gelatin.

The cavities or recesses 32 can have a shape other than the elliptical shape shown in FIGS. 3 and 4. For example, the recess 32 can have a hemispherical shape. Preferably the walls forming each recess 32 are shaped to the desired final contour or shape of the lower half of the completed tablet or capsule. Thus, as shown in FIG. 4, each cavity 32 can be formed with two straight sides 52, 54 that are joined together at opposite ends of the recess by semi-circular end walls 56. This results in an elongated elliptical shape for the recess when viewed from above. When viewed in cross-section along a longitudinal centreline, as shown in FIG. 3, each cavity 32 can have a rounded end wall 58 and a semi-cylindrical central portion at 60.

At the bottom of each recess 32 there is a vacuum port 62 and there could be two such vacuum ports for each recess, if desired. In the illustrated block, the ports 62 slope inwardly towards the transverse centerline of the block so that two ports meet at a single bottom opening 63 shown in FIG. 5. Each vacuum port leads from the bottom of the recess to a vacuum or suction shoe or box when the main linked track is at a predetermined location along its upper path. These vacuum ports are part of a vacuum applying system indicated generally at 64 for causing portions of the first gelatin strip or web 18 to be pulled and stretched against the aforementioned walls of the recesses 32 in the die blocks, thereby forming the tablet receiving depressions in this gelatin strip at an upstream location along the upper path 36 spaced from the aforementioned location of contact between the die device 28 and the main linked track 24. It will be understood that the die blocks 30 are also provided with ports similar to the ports 62 to permit the escape of air from the recesses formed in the blocks 30 during the enrobing process.

The die blocks 26 and 30 are accurately and firmly linked by pairs of chains to one another. In the illustrated main linked track, the die blocks 26 are attached to two continuous drive chains 66 and 67 (see FIGS. 5 and 6) which moves in an elliptical fashion about pairs of drive sprockets 220 to 223. The drive sprockets can be attached to the opposite sides of rolls 68 and 72. If desired, suitable known means can be provided to adjust the tension of the drive chains. The roll 72 of the same size as roll 68 is located at the start of the upper path 36. It will be appreciated that the rolls 68 and 72 and the drive chains 66, 67 comprise means for driving the main linked track for movement along its upper path and returned along a lower path 74. As indicated, the main linked track can be driven by a suitable stepper motor 330 shown schematically in FIG. 6 connected in a suitable manner to the shaft 82 for the roll. The stepper motor 330 can advance the main linked track in an intermittent stop-and-go manner. In one preferred embodiment, the track stops about 45 times per minute to allow tablets to be dropped into carefully positioned recesses of one of die blocks 26. Faster track speeds are also possible with this invention.

Also shown in FIG. 2 is a support framework for the various rolls for the main linked track and the second linked track. This support framework can include a base frame 76 resting on the floor or an elevated horizontal support surface and upwardly extending frames 77 to 79 rigidly connected to the base frame. The frame 77 rotatably supports the roll 72 by means of a shaft 80 mounted in suitable bearings. The frame 78 can rotatably support the roll 46 of the smaller linked track while the end frame 79 rotatably supports both the roll 68 and the smaller roll 48 by means of shafts 82 and 84 respectively. In one preferred embodiment, each of the rolls 68, 72, 46 and 48 are twelve sided with the circumferential length of each side corresponding approximately to the length L of each block 26, 30 (see FIG. 3). The diameter of these rolls can be about 8 inches. The frames 77 to 79 can also be used to support a horizontal table or frame 83 providing support for the linked track along its upper path 36. It will be understood that the various major components of the apparatus must be made to close tolerances, typically to a tolerance of 1/1000ths of an inch. This includes the die blocks, the chains 66, 67 and the rolls. The rolls can have circumferential recesses to accomodate the lock plates 296.

Turning now to the aforementioned vacuum applying system 64 for causing portions of the first gelatin strip or web to be pulled against the walls of the recesses in the die blocks, the system preferably includes a vacuum shoe or box 88. Suction or vacuum is applied along a predetermined portion of the upper path 36. In the illustrated embodiment shown in FIG. 2, this portion extends from a front end 90 of the vacuum box to a rear end 92. Vacuum is provided in the vacuum box 88 through a vacuum connection 94. A suitable vacuum seal 96 extends about the perimeter of the vacuum box 88. Suitable known materials for this strip include felt or a polymeric seal made of PTFE or polyacetal. It will be understood that the seal extends along both bottom edges of the main linked track as well as across the ends 90 and 92 of the box. The vacuum is applied to the vacuum ports 62 as the die blocks pass over the vacuum box 88. The vacuum causes the portion of the gelatin web 18 above each recess 32 to be pulled and stretched downwards until the stretched portion of the film takes the shape of the walls of the recess 32. However, the vacuum should not be so great or the port 62 so large that the gelatin film is pulled into the port. One can also use positive air pressure applied through the port 62 to discharge the coated capsules 12 from the downstream end of the linked track. This positive pressure is applied as the die blocks 26 pass around the roll 68. Reference can be made to U.S. Pat. No. 5,074,102 issued Dec. 24, 1992, the disclosure of which is incorporated herein by reference for an explanation as to how positive air pressure can be used in this manner.

Turning now to the schematic illustration of the preferred apparatus provided by FIG. 1, the gelatin films 16 and 18 are cast on separate, rotating casting drums 100 and 102 which can be made of steel and driven by their own stepper motors so their speed can be accurately controlled. These drums are air or water cooled in a known manner to maintain the cylindrical casting surface thereof at the required temperature for the formation of the gelatin. The drums create the gelatin webs in a continuous manner. Liquid gelatin stored in gelatin tanks or containers 104, 105 flows into a spreader box 106, 107 through a transfer tube or pipe 108 and 109. The containers 104 and 105 are heated in a known manner by a suitable heater (not shown) to keep the gelatin liquid and at the required temperature. If desired, the containers can be kept air tight and the liquid gelatin kept under air pressure to maintain its flow through the tubes 108, 109. It is also possible for the liquid gelatin to flow simply under the force of gravity.

The casting drums 100, 102 have a surface which is substantially colder than that of the liquid gelatin deposited on its rotating surface. The initially liquid gelatin, which is of predetermined thickness, solidifies on the rotating drum to form the films or webs 16, 18. The web or film is sufficiently strong that it can be led from the casting drums to the main linked track as illustrated in FIG. 1. In a known manner, preferably each gelatin web is drawn through a lubricant bath indicated at 110 by means of rollers 112 and 114. Each roller 114 can be a driven tractor roller. The lubricant in each bath 110 is applied mostly to the bottom surface of the film or web, that is the surface which comes into contact with the blocks on the linked tracks. The purpose of the thin layer of lubricant is to prevent the film or web from sticking to the die block, particularly the walls of each recess 32 and the recesses in the die device 28. Other known types of lubricant applicators can be used in lieu of the bath 110.

In a known manner, the tractor rolls 114 can be covered by a traction layer in the form of an elastomeric mesh which enables the roll to engage the gelatin film without slippage even though the film is covered with a thin layer of lubricant. One or more support rollers 116 to 118 can be provided to support and guide the gelatin webs 16, 18. These rollers will normally be free wheeling and mounted on bearings. It will be understood that the number and location of these rollers will depend upon the distances to be covered in the transfer of the web and any change of directions required for the web.

Preferably each web 16, 18 is driven and fed in a manner that a web loop 230, 232 is formed. The purpose of these loops is to provide some slack or excess material in order to accommodate the stop-and-go cycle of the linked tracks. Suitable sensors 235 to 238 can be provided to keep the size of the loops within preset limits. To explain further, the bottom sensors 235, 237 would sense when their respective loop 230, 232 has reached its maximum downward extension. They will then send a control signal to the drive motor for their respective tractor roller 114 to stop further rotation of the roller. The bottom of the loop will then move upwardly until it is sensed by the sensor at 236 or 238. The upper sensor will then send a further control signal to the motor for the roller 114 to commence rotation thereof again. The sensors 235 to 238 can be light beam sensors of known construction. It will be understood that the circumferential speed of the roller 114 is generally kept close to the average speed of its respective linked track in order to keep the stopping and starting of the roller 114 to a minimum.

Each of the webs 16, 18 is heated by one or more heating elements 120, 122 which are suspended above or near the respective web (see FIG. 2). These heating elements may comprise known radiant type heaters. As illustrated, the two heating elements 120 may be located close to the web 18 and close to the point where the web 18 is laid onto the moving track. The heating elements 122 are disposed close to the web 16 at a location where the web is laid over the dropped tablets and the bottom web 18. The web 16 should be applied to the bottom web at a point close to or at the nip 22 where the track 28 moves down to meet the main linked track. If desired, it can be applied to the block 30 located at 252 just before the block is rotated into engagement with the main linked track. In a known manner, the heaters heat the respective gelatin films on their obverse surfaces to a desired predetermined temperature, thus giving the films the desired elasticity for enrobing and sealing purposes.

After the two combined webs 16, 18 reach the end of the upper path 36 of the main linked track, the combined web passes between a pair of driven rolls 124 which can have a circumferential speed that is somewhat greater than the speed of the webs along the upper path 36. A standard electrical drive motor can be used to rotate the rolls 124. In this way, the combined web is stretched in the region between the linked track and the rolls 124. The stretching of the webs and the contact of the formed capsules with the rolls 124 help the enrobed capsules 12 to separate from the combined web. The enrobed capsules are guided by means of a suitable guide plate 126 into a suitable box or container 128. The completed capsules may then undergo further processing, if required, or they can be packaged for sale. For example, the capsules may be washed to remove the lubricant that was applied to the gelatin webs. They may also be dried and further special coatings may be applied, if required. The combined web 130 can be collected in a container 132, if desired. It is possible to reprocess the gelatin material of the combined web to make further liquid gelatin or it can be used for other known purposes.

Figure 7:
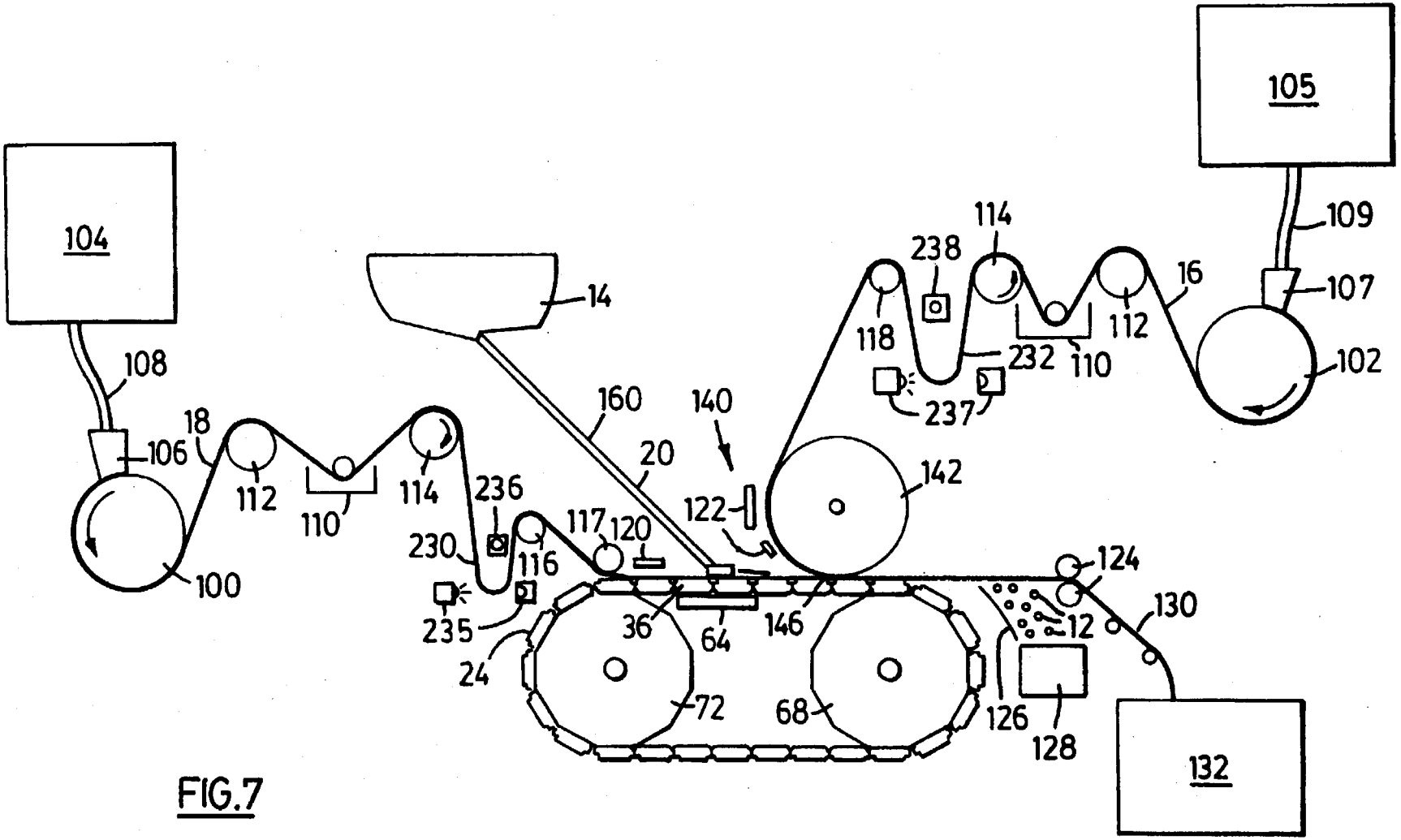
FIG. 7 is a simplified, partially schematic, perspective view of another form of apparatus for enrobing medicine tablets in a gelatin layer, this apparatus employing a cylindrical rotary die.
Figure 8:
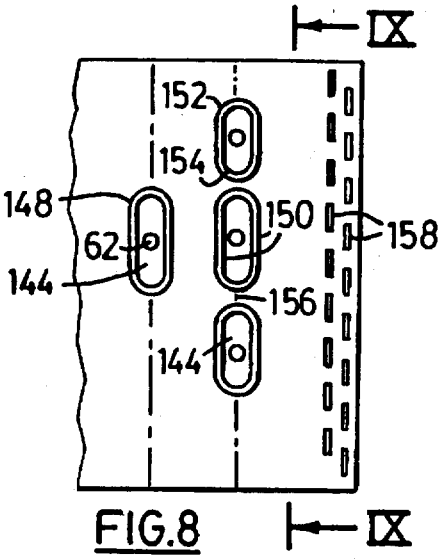
FIG. 8 is a partial side view of the rotary die device used in the apparatus of FIG. 7.
Figure 9:
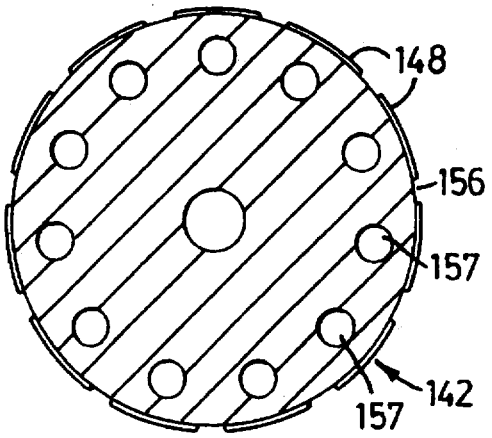
FIG. 9 is a cross-sectional view taken along the line IX—IX of FIG. 8, of the rotary cooperating die device.

Another embodiment of the invention is illustrated in FIGS. 7 to 9 of the drawings. This apparatus 140 is similar in its construction to the apparatus 10 except as described differently hereinafter. It will be noted that the same reference numbers have been used in FIG. 7 to identify various parts and components of this apparatus, which parts and components are the same or similar in their construction to the like numbered parts and components in the apparatus of FIGS. 1 and 2. The apparatus 140 for enrobing whole medicine tablets of predetermined size and shape with two gelatin webs 16 and 18 includes a linked track 24 of die blocks 26 with each block preferably having a number of recesses 32 formed therein. Instead of using a second linked track 28, the apparatus 140 has a cylindrical rotary die 142 having a cylindrical surface that at one point about the circumference of the die is adjacent to and in contact with the linked track 24. The rotary die is constructed in the manner shown in detail in FIGS. 8 and 9 and, in particular, it has a plurality of recesses 144, each of which is cooperative with one of the recesses 32 of similar size and shape in the linked track 24. Thus, at the one point where the rotary die meets the linked track, each recess 144 combines with a recess 32 to form an enclosed cavity capable of loosely holding one of the tablets or preforms that are dispensed from the bowl feeder 14. It will be understood that each dispensed tablet or preform moves with the first gelatin strip or web 18 to and past the point or nip located at 146. At this point, a portion of the second gelatin strip or web 16 is deformed and stretched in the adjacent recess 144 in the rotary die around the tablet into an enrobing engagement with the tablet.

The preferred construction of the rotary die 142 will now be described in detail with particular reference to FIGS. 8 and 9. Each recess 144 has a raised rim 148 extending about the perimeter of the recess. This raised rim serves the same purpose as the rims 50 extending about the recesses 32 described above. It will be noted that the die is intermittently driven in a stop-and-go manner at the required annular velocity so that its circumferential surface moves at the same speed and at the same time as the upper surface of the linked track. In a preferred embodiment, there is a separate electrical stepper motor for the rotary die 142 and the speed of the motor is controlled by a PC computer. It is also possible to slave the die 142 to the driven linked track 24 by means of gearing (not shown) between the die 142 and the driven roll 68 so that the surface velocity and movement of the die 142 is the same as that of the linked track 24 along its upper path.

Preferably each rim 148 has rounded edges both on the inside and the outside of the rim. As illustrated, each rim can have parallel opposite sides 150 which are parallel with the circumference of the die. Each end of the rim is shaped substantially in the form of a semi-circle as indicated at 152 and 154. As shown in FIG. 8, there are a number of rows of the recesses 144, which rows extend circumferentially of the rotary die. These rows are preferably equally spaced from each other across the width of the die. The recesses in each row are equally spaced from each other by a short distance indicated at 156. The distance 156 should be kept as small as practical, bearing in mind the function of the rims 148 which is to seal the films 16, 18 around the individual preforms and to cut the films as required. The preferred distance 156 can be determined by those skilled in this art by taking into account the thickness of the webs 16, 18 passing under the rotary die. One or more air escape ports 62 are provided at the bottom of each recess 144. These are connected to atmosphere by suitable air passageways 157 formed in the rotary die.

Preferably, rows of teeth 158 are arranged along each circumferential edge of the rotary die, one of these edges being shown in FIG. 8. The teeth 158 provide traction devices on the two ends of the die for gripping the gelatin film in a known manner. Preferably, the film 16 has a width greater than the axial length of the die 142 for this purpose.

The preferred material for the webs or strips 16, 18 is "gelatin" which includes gelatin and derivatives thereof. The term "gelatin" is also understood to include other proteins similar to gelatin in physical and chemical properties and gelatin combined with starch or derivatives thereof. Gelatins are generally produced by the partial hydrolysis of collagen which is obtained from the bones, white connective tissues and skin of animals, particularly pigs. Capsules made with said gelatin coating can be coloured. Gelatin can be plasticized by the addition of glycerin, sorbitol or a similar polyol. The soft gelatin material may contain a preservative to prevent the growth of fungi.

The soft gelatin capsules made with the apparatus of the present invention may contain a wide variety of medicinal compounds which include drugs and vitamins. It will be seen that the capsules made with the apparatus of the invention provide a convenient means for delivering to a patient a small, accurate dosage of an active ingredient material.

Figure 10:
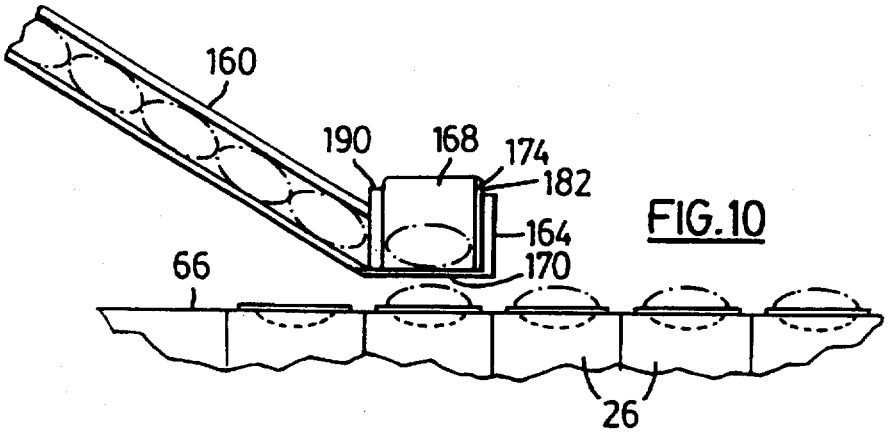
FIG. 10 is a detail view taken in cross-section along the line X—X of FIG. 11 showing a tablet dispensing mechanism.
Figure 11:
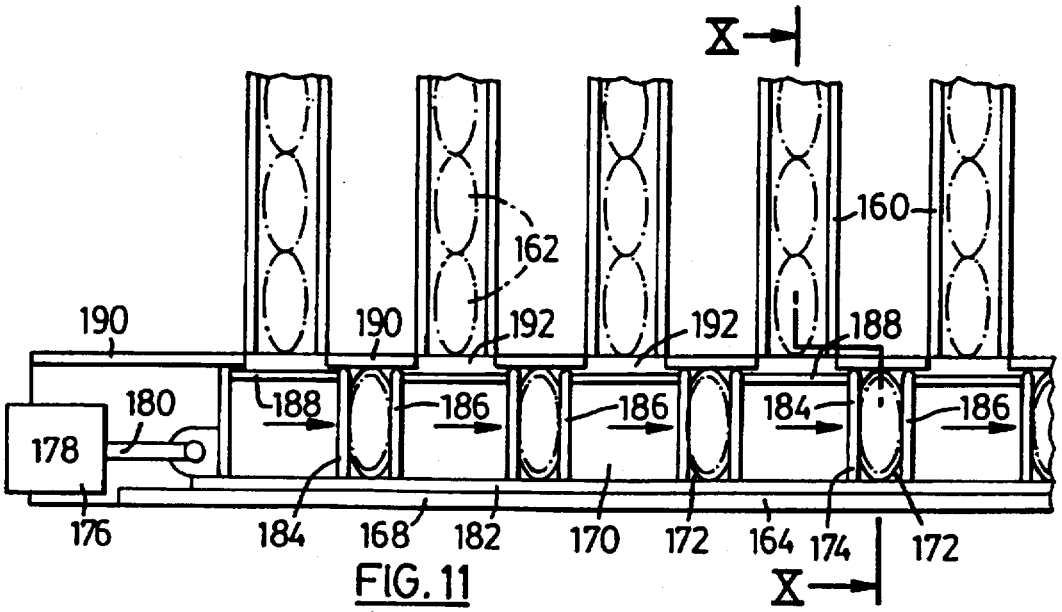
FIG. 11 is a detail plan view of the tablet dispensing mechanism of FIG. 10.

In addition to the heating devices for heating the gelatin strips already described above, there can also be provided other conditioning means for the gelatin strips so that these strips will have a predetermined deformability and adhesivity to the tablets and to each other. For example, the entire apparatus 10, 140 is best located in an air conditioned room so that both temperature and humidity may be controlled to maintain the desired condition of the films or webs. Also, the casting drums 100, 102 can, if desired, be covered with suitable shields that do not interfere with their rotation. An exhaust duct can then be attached to this shield in a known manner to exhaust air from under the shield and pull in dry conditioned air to dry and condition the surface of the gelatin film. It should also be noted that the casting drums 100, 102 are driven in a suitably timed relationship with the rest of the apparatus by their stepper motors (not shown). One form of tablet dispensing mechanism 20 is illustrated in part in FIGS. 10 and 11. The aforementioned bowl feeder 14 is of standard construction and is designed in a known manner to feed the preforms down a number of vertically extending chutes 160, five of which are illustrated in FIG. 11. The chutes are each sized to receive the preforms arranged in a single line and properly oriented and they are arranged side-by-side across the width of the main track. The bowl feeder orients the preforms correctly before they enter the chutes 160. The number of chutes 160 corresponds to the number of longitudinal rows of recesses 32 in the main linked track. In the illustrated machine the preforms 162 are oriented so that their longitudinal axes are aligned. Preferably the chutes are made of a slippery, non-abrasive material so that the preforms slide easily therealong. The inclination of the chutes should be sufficiently great that the preforms will slide easily therealong under the force of gravity but it should not be so great as to put any undue weight on the preforms at the bottom of the chutes. The chutes extend downwardly to a location near a top surface 166 of the main track 24.

The tablet dispensing mechanism preferably includes a timing device 164 for releasing one whole tablet at a time from each chute 160. The timing device is adapted to operate by reference to the position of the main linked track in its revolving cycle of operation. The timing device includes a mechanism 168 for dropping individual whole tablets 162 into respective depressions in the gelatin strip 18 as the strip passes under the mechanism and when the strip is stopped momentarily. The mechanism 168 is connected to the bottom ends of the chutes 160 and it has a tablet supporting bottom 170 extending transversely across the linked track. The preferred bottom 170 is a flat metal plate having one aperture 172 for each of the chutes 160. Thus, in the embodiment of FIGS. 10 and 11 there are at least five apertures 172 spaced equally apart. The apertures are each sized to permit a single tablet or preform having the desired orientation to drop through it and onto the gelatin web.

Each dropping mechanism includes a sliding feed member 174 mounted to slide on the bottom 170 in a transverse direction relative to the linked track. A drive device 176 is able to slide the feed member 174 at timed intervals in order to move each tablet, that is resting on the bottom 170, transversely to a position where it drops through one of the apertures 172. The illustrated drive device is a pneumatic cylinder 178 that is able to quickly move a piston rod 180 connected to one end of the feed member. The feed member 174 includes a transversely extending, elongate, connecting plate 182 and a number of vertical pusher plates 184 that are rigidly secured to the plate 182. Optionally, additional tablet holding plates 186 can be rigidly connected to the plate 182 with each plate 186 being spaced the width of a preform from a respective plate 184. A tablet stopper plate 188 can be provided between a front edge of each plate 186 and the next pusher plate 184. The plates 188 prevent any preforms from sliding onto the bottom 170 during the transverse forward and backward movement of the feed member 174. An additional fixed support plate 190 can be rigidly connected to one edge of the bottom 170 and to each of the chutes 160. Apertures 192 are formed in the plate 190 for the passage of the preforms through this plate.

Figure 6:
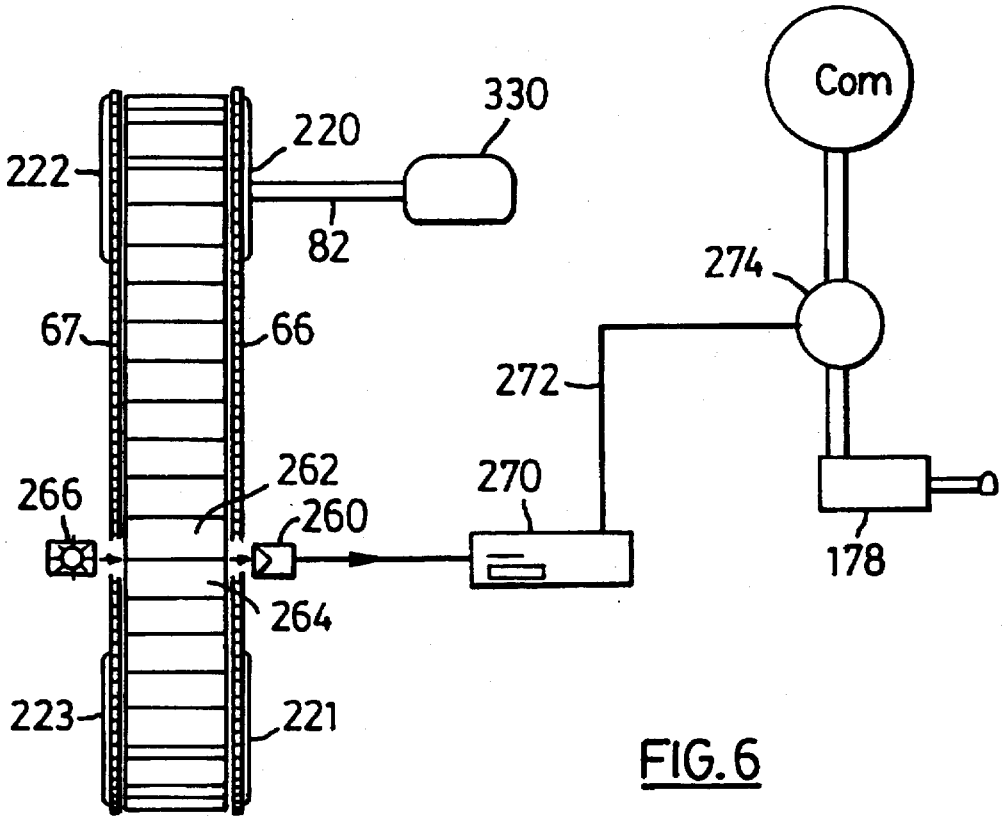
FIG. 6 is a schematic illustration of the control system used to drop tablet preforms onto the gelatin web on the main linked track.

A variety of devices can be used to sense or indicate the position of the main linked track and then to operate the tablet dropping mechanism. Whatever device is used must be sufficiently precise or sensitive that it will cause the drive device 176 to operate precisely when required to drop the preforms into their respective depressions in the gelatin strip. One such device is schematically illustrated in FIG. 6 and includes a light sensor 260 such as a fiberoptic sensor of known construction. The sensor is able to detect accurately the position of one or both of the blocks 26 located at 262 and 264 which are located close to or at the position of the tablet timing device 164. A focused light beam from a light emitter 266 directs a narrow light beam across the linked track and, when the emitter is aligned with one of the narrow channels 268 formed between adjacent rows of cavities the beam will be picked up by the light sensor on the other side of the track, thereby indicating the precise position of the blocks. This will then cause a control signal to be sent to a suitable microprocessor 270 such as a PC computer. The microprocessor then sends an electrical signal through line 272 to operate a standard, electrically operated air valve 274 connected to air compressor 276 (or other source of compressed air) and to the air cylinder 178. In this way, the dropping of the tablets can be precisely and accurately timed and will only occur when the movement of the main track is momentarily stopped.

An optional feature in both embodiments is a tablet engaging plate 340 located just downstream from the tablet dispenser 164 and extending across the upper surface of the main track. The plate 340 can be curved or flat (as shown) and arranged at a small angle to the horizontal plane. The purpose of this plate is to ensure that the dropped tablets are fully received in their depressions in the film. If the tablet has not dropped to the bottom of the depression, the plate 34 will act to push the tablet fully into the depression as the tablet passes under the plate.

Figure 12:
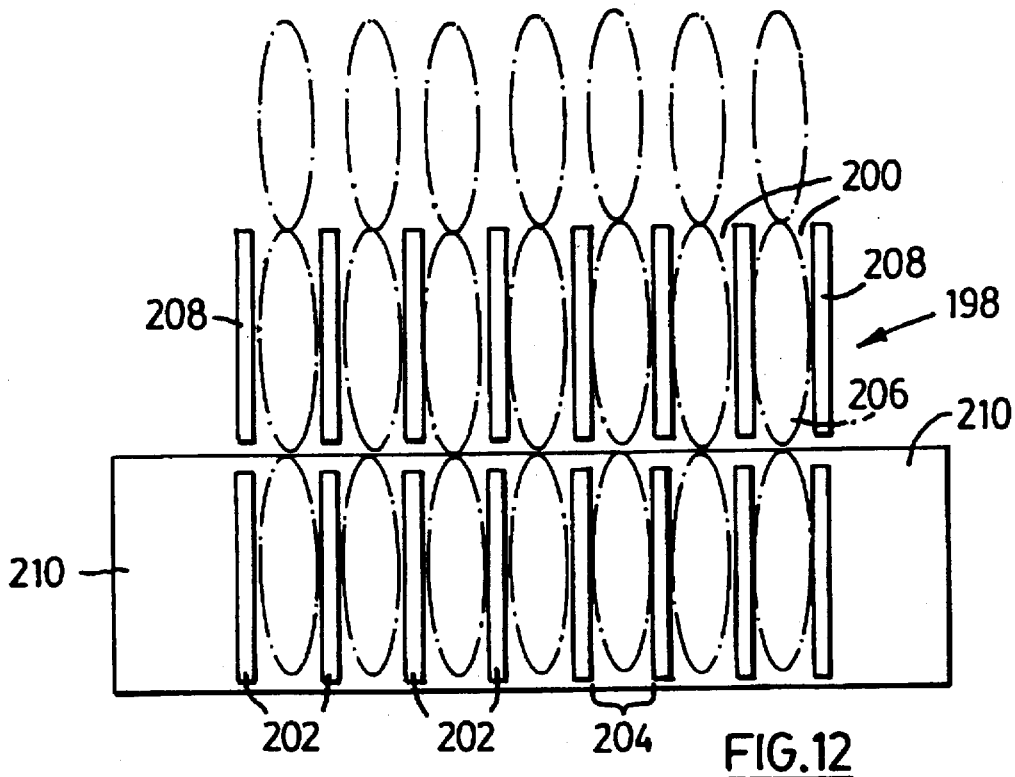
FIG. 12 is a schematic plan view illustrating another similar form of tablet dispensing mechanism in its loading position.
Figure 13:
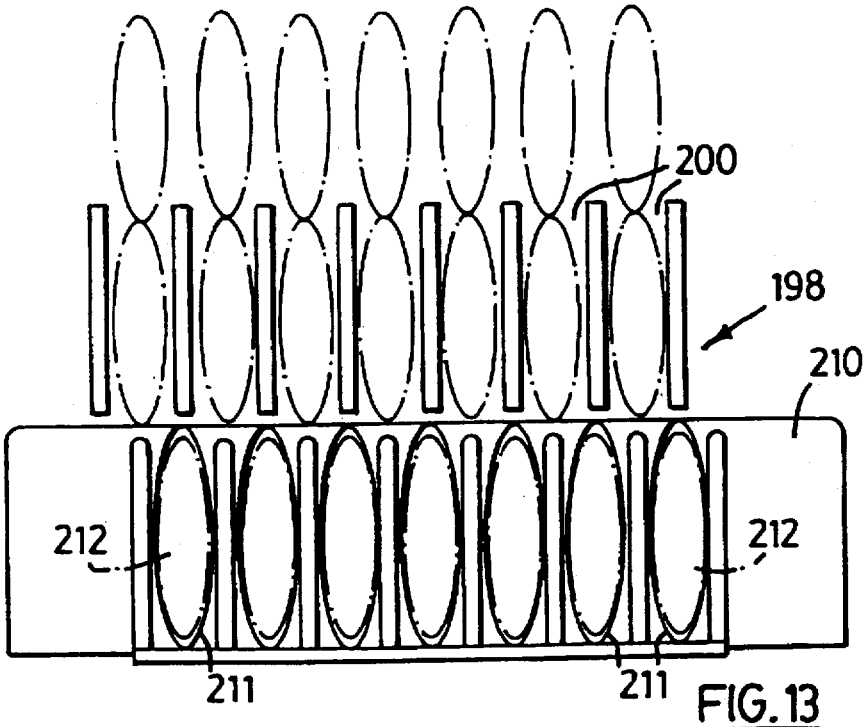
FIG. 13 is a schematic plan view showing the tablet dispensing mechanism of FIG. 12 in its unloading position.

FIGS. 12 and 13 illustrate an alternative form of tablet dispensing mechanism indicated generally at 198. This mechanism operates in the same manner and with the same components as the embodiment of FIGS. 10 and 11 except as explained to be different hereinafter. The arrangement of FIGS. 12 and 13 permits preforms to be dispensed in a close side-by-side arrangement. Seven chutes 200 are illustrated in this version and it will be understood that the number of chutes could be fewer or more. The sliding feed member of this tablet dispenser has a number of vertically extending pusher plates 202 with the width of the gap 204 between the plates just slightly more than the width of each preform 206 and about equal to the width of the passageway of each chute 200. The plates 202 are rigidly connected to a connecting plate (or bars) (not shown). In the loading position shown in FIG. 12, the pusher plates 202 are aligned with sides 208 of the chutes. In this position the preforms are free to slide onto tablet supporting bottom 210. In the unloading position shown in FIG. 13, the pusher plates 202 have been moved transversely by one-half the width of the gap 204. In this position the transverse row of preforms at 212 are free to drop through apertures 211 in the bottom 210 and onto the gelatin strip. At the same time the pusher plates 202 act to block downward movement of the preforms in the chutes 200. In this dispenser there are no holding plates 186 and no stopper plates 188.

Instead of employing the tablet dispensing mechanism described above and illustrated in FIGS. 1, 2 and 10 to 13, one could also employ known tablet dispensing mechanisms such as that illustrated in FIG. 26 of U.S. Pat. No. 5,459,983, the specification and drawings of which are incorporated herein by reference. In this known preform dispenser, the preforms pass through vertically extending chutes or tubes having passageways therein. An eccentric cam is mounted on a drive shaft so that the cam extends into its respective tube passageway through a side opening and contacts a tablet in the passageway. The cam contour is defined in combination with the rate of rotation of its shaft to engage a tablet in the passageway each time a row of recesses in the blocks 26 reaches a desired position at the bottom end of the chutes and to drive the tablet stack a desired distance downwardly in its passageway. This distance is sufficient to permit the lowermost tablet in the chute to drop out of the chute and onto the web 18. A resilient element, ie. a leaf spring, is mounted at the bottom end of each chute to hold the lowermost tablet in the chute until the aforementioned cam operation forces it past the resilient element.

Many variations of the present invention will suggest themselves to those skilled in this art in light of the above detailed description. Accordingly, all such modifications and changes as fall within the scope of the appended claims are intended to be part of this invention.

I therefore claim:

1. An apparatus for enrobing medicine tablets in a gelatin layer, said apparatus comprising:

a main linked track of die blocks with each block having at least one recess formed in a top surface thereof;

means for driving said linked track for movement along an upper path and return along a lower path;

a revolving co-operating, die device that is adjacent to and in contact with said main linked track, said die device having a plurality of recesses each of which is cooperable with a recess of similar size in said linked track to provide an enclosed cavity at at least one point along said upper path, said cavity being capable of holding one of said tablets;

a drive system for revolving said die device so that the die device revolves in synchronism with the movement of said linked track;

feed means for delivering a first gelatin strip of selected thickness and composition to said main linked track, said first gelatin strip being positioned for generally linear movement along said upper path;

a vacuum applying system for causing portions of said first gelatin strip to be pulled and stretched against walls of the recesses in said die blocks, thereby forming tablet receiving depressions in said first gelatin strip at an upstream location along said upper path spaced from the location of contact between said die device and said linked track;

means for conditioning said first gelation strip before said strip reaches said location of contact so that the first strip has a predetermined deformability and adhesivity to the tablets and a second gelatin strip;

a timed tablet dispensing mechanism for dispensing individual whole tablets into said depressions at a feeding location positioned between said upstream location and said location of contact, said tablets being dispensed so as to have a desired orientation in said depressions; and means for delivering a second gelatin strip of selected thickness and composition so that said second strip is laid over said first gelatin strip and dispensed tablets when the two strips reach said location of contact between said die device and said linked track, wherein each dispensed tablet moves with said first gelatin strip to said location of contact and a portion of said second gelatin strip is stretched in one of said recesses in said die device so that the tablet can be enrobed by portions of both said first and said second gelatin strips.

2. An apparatus according to claim 1 wherein each die block in said main linked track has a number of recesses arranged in one or more rows extending transversely of said main linked track.

3. An apparatus according to claim 2 wherein said tablet dispensing mechanism includes a bowl feeder and a number of vertically extending tablet chutes which in operation are fed properly oriented whole tablets by said bowl feeder.

4. An apparatus according to claim 1 wherein said die device comprises a second linked track of die blocks with each of these die blocks having at least one recess formed in an outwardly facing surface thereof and dimensioned at least in transverse and longitudinal directions thereof so as to correspond substantially to the size of the recesses in said main linked track.

5. An apparatus according to claim 4 wherein said second linked track has a lower path along which said second linked track follows closely said upper path of said main linked track, said apparatus including means for driving said second linked track for movement along its lower path and return along an upper path.

6. An apparatus according to claim 5 wherein said tablet dispensing mechanism includes a bowl feeder and a number of vertically extending tablet chutes which in operation are fed properly oriented whole tablets by said bowl feeder.

7. An apparatus according to claim 6 wherein said die blocks in said main linked track have vacuum ports formed therein and connected to the recesses in said die blocks, said vacuum ports being part of said vacuum applying system which includes a vacuum shoe mounted adjacent to said main linked track and along the upper path thereof.

8. An apparatus according to claim 1 wherein said die blocks and said die device include means for sealing together stretched portions of said first and second gelatin strips substantially along a line about and close to each tablet and for separating each tablet from the gelatin films.

9. An apparatus according to claim 8 wherein said die device comprises a second linked track of die blocks with each of these die blocks having at least one recess formed in an outwardly facing surface thereof and dimensioned in transverse and longitudinal direction thereof so as to correspond substantially to the size of the recesses in said main linked track.

10. An apparatus according to claim 4 wherein said tablet dispensing mechanism includes a number of vertically extending tablet chutes arranged across the width of said main linked track and a timing device for releasing one whole tablet at one time from each chute, said timing device being adapted to operate by reference to the position of said main linked track in its revolving cycle of operation.

11. An apparatus for enrobing whole medicine tablets of predetermined size and shape with a gelatin layer, said apparatus comprising:

a linked track of die blocks with each block comprising at least one recess formed in a top surface thereof;

means for driving said linked track for movement along an upper path and return along a lower path;

a cylindrical rotary die having a cylindrical surface that at one point about the circumference of the die is adjacent to and in contact with said linked track, said rotary die having a plurality of recesses each of which is cooperable with a recess of similar size in said linked track to provide at said one point an enclosed cavity capable of loosely holding one of said tablets;

a drive system for rotating said rotary die so that the rotary die moves in synchronism with the movement of said linked track;

first feed means for delivering a first gelatin strip of selected thickness and composition to said upper path for generally linear movement therealong;

second feed means for delivering a second gelatin strip of selected thickness and composition to said rotary die for movement along a circular path to said one point where the second gelatin strip meets said first gelatin strip;

a vacuum applying system for causing portions of said first gelatin strip to be pulled against walls of the recesses in said die blocks, thereby forming tablet receiving depressions in the first gelatin strip at an upstream location along said upper path spaced from said one point;

a timed tablet dispensing mechanism for dispensing individual whole, solid tablets into said depressions at a feeding location positioned between said upstream location and said one point, said tablets being dispensed so as to have a desired orientation in said depressions; and means for conditioning said gelatin strips before said strips reach said one point so that the strips have a predetermined deformability and adhesivity to the tablets and to each other;

wherein each dispensed tablet moves with said first gelatin strip to and past said one point and a portion of said second gelatin strip is deformed and stretched in one of said recesses in said rotary die around the tablet into enrobing engagement with the tablet.

12. An apparatus for enrobing tablets according to claim 11 wherein each die block has a number of recesses arranged in at least one row extending in the widthwise direction of said track.

13. An apparatus for enrobing tablets according to claim 11 wherein each recess in the die blocks and in the rotary die has a raised rim extending about the perimeter of the recess and said die blocks are attached together by means of two linked chains located on opposite sides of the linked track.

14. An apparatus for enrobing tablets according to claim 13 wherein said conditioning means includes at least one radiant heater positioned above and close to each of said first and second gelatin strips.

15. An apparatus for enrobing tablets according to claim 11 wherein said tablet dispensing means includes one or more inclined chutes extending downwardly to a location near a top surface of said linked track, means for feeding whole tablets into said one or more chutes so that the tablets have a desired orientation in the or each chute, and a mechanism for dropping individual whole tablets into respective depressions in said first gelation strip as the strip passes under the mechanism, said dropping mechanism being connected to said one or more chutes and having a tablet supporting bottom extending transversely across said linked track, said bottom having one or more apertures through which a single tablet having said desired orientation can drop.

16. An apparatus for enrobing tablets according to claim 15 wherein said dropping mechanism includes a sliding feed member mounting to slide on said supporting bottom in a transverse direction relative to the linked track and a drive device for sliding said feed member transversely at timed intervals, wherein a whole tablet provided by each chute and resting on said tablet supporting bottom can be moved transversely by said feed member to a position where it drops through the aperture or one of the apertures in said tablet supporting bottom.

17. An apparatus for enrobing tablets according to claim 16 wherein said feeding means is a vibrating bowl feeder and there are a number of said inclined chutes connected to said bowl feeder and fed thereby.

18. An apparatus for enrobing tablets according to claim 11 wherein said vacuum applying system includes a vacuum box arranged below a portion of said linked track along its upper path and said die blocks are formed with vacuum ports that open into the recesses in the die blocks and that are open along bottom surfaces of said die blocks.

19. An apparatus for dispensing tablets into an elongate digestible web that is moving longitudinally in a tablet manufacturing machine, said apparatus comprising:

means for feeding tablets so that said tablets are arranged in one or more rows and all have a desired orientation;

one or more chutes that extend downwardly from said feeding means, one of said chutes being provided for each of said rows;

a slide mechanism for dropping individual, properly oriented tablets onto an upper surface of said web, said mechanism being mounted to receive tablets deposited thereon from a bottom end of said one or more chutes, said mechanism including a tablet supporting bottom that extends generally horizontally and has an aperture for the or each chute, the or each aperture being dimensioned to permit single, properly oriented tablets to drop therethrough, and also a sliding feed member mounted to slide relative to said supporting bottom in a direction transverse to the longitudinal movement of the web and to thereby move one or more tablets transversely to a position directly over the or a respective one of the apertures;

a drive device for sliding said feed member transversely first to a tablet dropping position and then back to a tablet loading position; and a control system for operating said drive device at correctly timed intervals so that properly oriented tablets are dropped onto said digestible web at desired locations thereon.

20. An apparatus according to claim 19 wherein said feeding means is a bowl feeder capable of providing a number of rows of tablets and wherein there are a number of chutes connected to said bowl feeder.

21. An apparatus according to claim 19 wherein there are a number of chutes and a corresponding number of apertures in said tablet supporting bottom and said feed member includes a number of vertically extending pusher plates and a transversely extending, connecting plate to which said pusher plates are connected, said feed member being mounted to slide on said supporting bottom.

22. An apparatus according to claim 19 wherein said drive device is a pneumatic cylinder and piston device operatively connected to said feed member and said control system includes means for sensing the position of a linked track on which said web is able to move longitudinally, said linked track comprising a number of die blocks that are hinged together to form a continuous track.

23. An apparatus according to claim 20 wherein said chutes are arranged in a close side-by-side manner and said feed member includes a number of vertically extending pusher plates, adjacent pusher plates being spaced apart by a distance generally equal to the width of said tablets and generally equal to the width of a tablet passageway formed by each chute, and wherein said pusher plates act to prevent downward movement of tablets in said chutes when said feed member is in said tablet dropping position.

24. An apparatus for enrobing tablets in a gelatin or gelatin-like layer, said apparatus comprising:

first and second linked tracks of die blocks with each block having at least one recess formed in an outer surface thereof;

means for intermittently driving both of said linked tracks for movement of each along a continuous path and in synchronism with the other, wherein the continuous paths of the tracks run parallel to and immediately adjacent each other along a portion of each path;

means for delivering a first gelatin or gelatin-like strip to the first linked track for movement along a section of the continuous path of said first linked track;

a vacuum applying system for causing portions of said first strip to be pulled and stretched against walls of the recesses in the die blocks of the first linked track, thereby forming tablet receiving depressions in said first strip at a location upstream from said portion of each path where the tracks are adjacent each other;

a tablet dispensing mechanism for dispensing properly oriented whole tablets into said depressions at a feeding location positioned upstream from said portion of each path where the tracks are adjacent each other, the tablets being dispensed when said first linked track is stopped; and means for delivering a second gelatin or gelatin-like strip so that the second strip is laid over said first strip when the first strip reaches said portion of each path where the tracks are adjacent each other;

wherein each recess in each die block of one linked track is cooperable with a recess of similar size in a die block of the other linked track to provide an enclosed cavity capable of holding one of the tablets, said cavity being formed along the portions of the paths where the tracks are adjacent each other, and wherein portions of the second strip are stretched in the recesses of the die blocks of the second linked track when respective cooperating die blocks of both tracks engage each other so that tablets are enrobed by portions of both the first and second strips.

25. An apparatus according to claim 24 wherein each die block of each linked track has a number of recesses arranged in one or more rows extending transversely of the respective linked track.

26. An apparatus according to claim 24 wherein said die blocks of the first linked track have vacuum ports formed therein and connected to respective recesses in the die blocks, said vacuum ports being part of said vacuum applying system which includes a vacuum shoe mounted adjacent to an upper path of said first linked track.

27. An apparatus according to claim 25 wherein said tablet dispensing mechanism includes a number of vertically extending tablet chutes arranged across the width of said first linked track and a timing device for releasing one whole tablet at one time from each chute, said timing device operating with reference to the position of said first linked track along its continuous path.

28. An apparatus according to claim 27 wherein said timing device includes a microprocessor and light means for sensing the position of said first linked track and transmitting an electrical control signal indicative thereof to said microprocessor, said light means including means for sending a narrow beam of light through one of a number of transversely extending, narrow channels formed in said first linked track and a light sensor for receiving said narrow beam after it passes through one of said narrow channels and generating said control signal.

29. An apparatus according to claim 24 wherein said driving means for each linked track is an electric stepper motor capable of advancing its respective linked track a short distance a number of times per minute.

30. An apparatus according to claim 24 wherein each linked track includes two parallel, continuous drive chains connected to each other by means of elongate chain pins to which said die blocks are connected and rotatable connectors for detachably securing each die block to two of said chain pins.

31. An apparatus according to claim 30 wherein said rotatable connectors are locking plates attached to bottoms of their respective die blocks and rotatable between a first position where the die blocks can be removed from their respective chain pins and a second position where the die blocks are connected to their respective chain pins.

32. An apparatus according to claim 28 wherein said narrow channels comprise central channels extending across the center of the die blocks and oppositely facing cut-outs formed in upper transverse edges of said die blocks, the combined size of two immediately adjacent cut-outs corresponding to the size of each central channel.

33. An apparatus according to claim 32 wherein each central channel has a first narrow channel formed in the bottom thereof and each pair of immediately adjacent cut-outs is also able to form a further narrow channel corresponding in size to said first narrow channel.

34. An apparatus according to claim 25 wherein said driving means includes two pairs of multi-sided rolls with one of said pairs rotatably supporting said first linked track and the second pair rotatably supporting said second linked track, each of said rolls having a number of flat sides extending about its circumference.

35. An apparatus according to claim 27 wherein said timing device includes a slide mechanism for dropping individual, properly oriented tablets onto an upper surface said first strip, said slide mechanism being mounted to receive tablets deposited thereon from bottom ends of said chutes and including a tablet supporting bottom that extends generally horizontally and has an aperture for each chute and a sliding feed member mounted to slide relative to said supporting bottom.

* * * * *